US007234307B2

(12) United States Patent
Arman et al.

(10) Patent No.: US 7,234,307 B2
(45) Date of Patent: Jun. 26, 2007

(54) CRYOCOOLER WITH GROOVED FLOW STRAIGHTENER

(75) Inventors: Bayram Arman, Grand Island, NY (US); Arun Acharya, East Amherst, NY (US); Al-Khalique S. Hamilton, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 93 days.

(21) Appl. No.: 11/102,796

(22) Filed: Apr. 11, 2005

(65) Prior Publication Data

US 2006/0225435 A1 Oct. 12, 2006

(51) Int. Cl.
*F25B 9/00* (2006.01)

(52) U.S. Cl. ..... 62/6

(58) Field of Classification Search ..... 62/6; 165/4

See application file for complete search history.

(56) References Cited

U.S. PATENT DOCUMENTS 3,358,459 A * 12/1967 Tam ..... 62/6
3,431,746 A * 3/1969 Garrett et al. ..... 62/86
4,478,046 A * 10/1984 Saito et al. ..... 62/6
4,901,787 A * 2/1990 Zornes ..... 165/4
5,647,219 A * 7/1997 Rattray et al. ..... 62/6
6,082,117 A * 7/2000 Funatsu et al. ..... 62/6
6,374,617 B1 4/2002 Bonaquist et al. ..... 62/6
6,640,553 B1 11/2003 Kotsubo et al. ..... 62/6
6,715,300 B2 * 4/2004 Longsworth ..... 62/6
6,854,509 B2 * 2/2005 Mitchell ..... 165/10
2004/0000149 A1 * 1/2004 Kirkconnell et al. ..... 62/6

OTHER PUBLICATIONS

C. Wang, G. Thummes, C. Heiden, "Expimental study of staging method for two-stage pulse tube refrigerators for liquid 4He temperatures", Cryogenics, 1997, vol. 37, issue 12, p. 857-863.*

* cited by examiner

*Primary Examiner*—Cheryl Tyler
*Assistant Examiner*—John Pettitt
(74) *Attorney, Agent, or Firm*—David M. Rosenblum

(57) ABSTRACT

A cryocooler system having at least one flow straightener which has a system of grooves on its perforated surface for enhancing gas flow uniformity through the system wherein pulsing gas which does not initially pass through the flow straightener through a perforation flows along the surface of the flow straightener within a groove prior to passing through a perforation and is effectively redistributed across the surface of the flow straightener and thus the cross section of the regenerator or thermal buffer tube.

5 Claims, 3 Drawing Sheets

CRYOCOOLER WITH GROOVED FLOW STRAIGHTENER

TECHNICAL FIELD

This invention relates generally to low temperature or cryogenic refrigeration and, more particularly, to cryocoolers for the generation of such cryogenic refrigeration.

BACKGROUND ART

A recent significant advancement in the field of generating low temperature refrigeration is the pulse tube and other cryocooler systems wherein pulse energy is converted to refrigeration using an oscillating gas. Such systems can generate refrigeration to very low levels sufficient, for example, to liquefy helium.

One problem with conventional cryocooler systems is the loss of effective load heat capacity and flow uniformity and the resulting heat transfer maldistribution in the regenerator portion of the cryocooler which leads to operational inefficiency. These problems are particularly troublesome when the cryocooler is operated to provide very low temperature refrigeration such as below 40K.

SUMMARY OF THE INVENTION

One aspect of the invention is:

A cryocooler comprising a pressure wave generator and a regenerator which contains heat transfer media, and having at least one flow straightener comprising a plate having a plurality of perforations and a plurality of grooves in the plate surface, and positioned to, at least one of, retain heat transfer media within the regenerator and enhance gas flow uniformity through the regenerator.

Another aspect of the invention is:

A cryocooler comprising a pressure wave generator and a thermal buffer tube, and at least one flow straightener comprising a plate having a plurality of perforations and a plurality of grooves in the plate surface and positioned to enhance gas flow uniformity through the thermal buffer tube.

A further aspect of the invention is:

A method for operating a cryocooler comprising generating a pulsing gas for flow within the cryocooler which contains at least one flow straightener comprising a plate having a plurality of perforations and a plurality of grooves in the plate surface, and passing some of said gas along the plate surface within the grooves prior to passing the gas through perforations.

As used herein the term "pressure wave generator" means an electromechanical, mechanical, or thermoacoustic device that produces pressure waves in the form of acoustic energy.

As used herein the term "longitudinal axis" means an imaginary line running through a regenerator or thermal buffer tube in the direction of the gas flow.

As used herein the term "regenerator" means a thermal device containing heat transfer media which has good thermal capacity to cool incoming warm gas and warm returning cold gas via direct heat transfer with the heat transfer media.

As used herein the terms "thermal buffer volume" and "thermal buffer tube" mean a cryocooler component separate from the regenerator, proximate a cold heat exchanger and spanning a temperature range from the coldest to the warmer heat rejection temperature.

As used herein the term "indirect heat exchange" means the bringing of fluids into heat exchange relation without any physical contact or intermixing of the fluids with each other.

As used herein the term "direct heat exchange" means the transfer of refrigeration through contact of cooling and heating entities.

DETAILED DESCRIPTION

Figure 1:
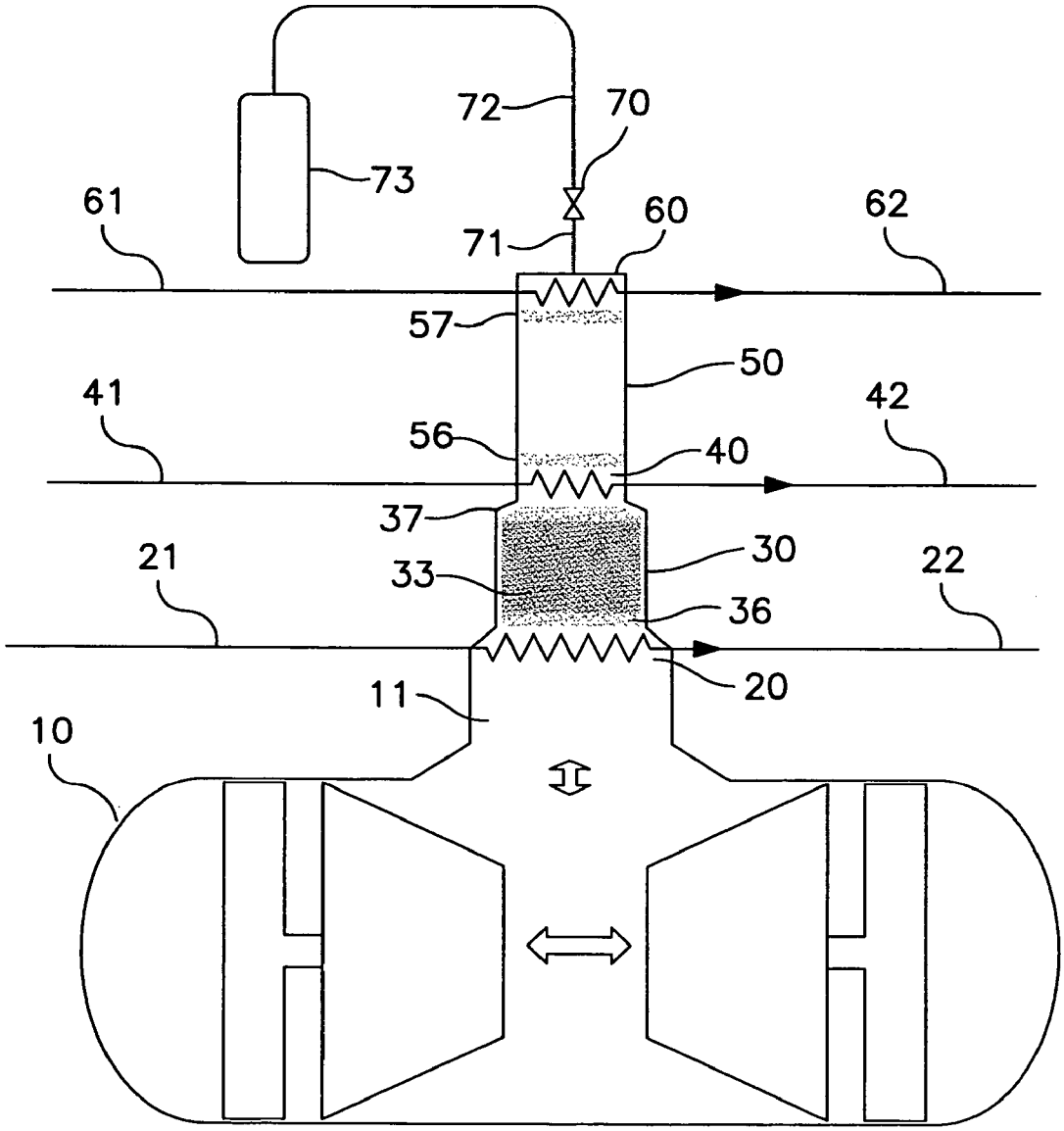
FIG. 1 is a representation of one preferred cryocooler assembly of this invention wherein the cryocooler is a single stage pulse tube type cryocooler.

The invention will be described in greater detail with reference to the Drawings. Referring now to FIG. 1, pressure wave generator 10, which may be a compressor driven by a linear or rotary motor, generates a pulsing gas to drive a cryocooler such as the pulse tube cryocooler illustrated in FIG. 1. The pulsing working gas pulses within the pressure wave pathway which comprises the pressure wave generator, a regenerator and a thermal buffer volume. In the pulse tube type cryocooler illustrated in FIG. 1, the pressure wave pathway also includes a reservoir downstream of the thermal buffer volume. Typically the working gas comprises helium. Other gases which may be used as working gas in the practice of this invention include neon, argon, xenon, nitrogen, air, hydrogen and methane. Mixtures of two or more such gases may also be used as the working gas.

The pulsing working gas through passageway 11 applies a pulse to the hot end of the regenerator 30 thereby generating an oscillating working gas and initiating the first part of the pulse tube sequence. The pulse serves to compress the working gas producing hot compressed working gas at the hot end of the regenerator 30. The hot working gas is cooled, preferably by indirect heat exchange with heat transfer fluid 21, 22 in hot heat exchanger 20 to cool the compressed working gas of the heat of compression. Heat exchanger 20 is also the heat sink for the heat pumped from the refrigeration load against the temperature gradient by the regenerator 30 as a result of the pressure-volume work generated by the pressure wave generator.

Regenerator 30 contains heat transfer media and has flow straighteners and bed retainers as will be more fully described below. The pulsing or oscillating working gas is cooled in regenerator 30 by direct heat exchange with cold heat transfer media to produce cold pulse tube working gas.

Thermal buffer volume or tube 50, which in the arrangement illustrated in FIG. 1 is a pulse tube, and regenerator 30 are in flow communication. The flow communication includes cold heat exchanger 40. The cold working gas passes to cold heat exchanger 40 and from cold heat exchanger 40 to the cold end of thermal buffer tube 50. Within cold heat exchanger 40 the cold working gas is warmed by indirect heat exchange with a refrigeration load thereby providing refrigeration to the refrigeration load. In FIG. 1, the refrigeration load is represented by stream 41 which is passed to cold heat exchanger 40 and which emerges therefrom as stream 42. One example of a refrigeration load is for use in a magnetic resonance imaging system. Another example of a refrigeration load is for use in high temperature superconductivity.

The working gas is passed from the regenerator 30 to thermal buffer tube 50 at the cold end. As the working gas passes into thermal buffer volume 50, it compresses gas in the thermal buffer volume or tube and forces some of the gas through warm heat exchanger 60 and orifice 70 in lines 71 and 72 into the reservoir 73. Flow stops when pressures in both the thermal buffer tube and the reservoir are equalized.

Cooling fluid is passed in line 61 to warm heat exchanger 60 wherein it is warmed or vaporized by indirect heat exchange with the working gas, thus serving as a heat sink to cool the compressed working gas. The resulting warmed or vaporized cooling fluid is withdrawn from heat exchanger 60 in line 62.

In the low pressure point of the pulsing sequence, the working gas within the thermal buffer tube expands and thus cools, and the flow is reversed from the now relatively higher pressure reservoir 73 into the thermal buffer tube 50. The cold working gas is pushed into the cold heat exchanger 40 and back towards the warm end of the regenerator while providing refrigeration at heat exchanger 40 and cooling the regenerator heat transfer media for the next pulsing sequence. Orifice 70 and reservoir 73 are employed to maintain the pressure and flow waves in phase so that the thermal buffer tube generates net refrigeration during the compression and the expansion cycles in the cold end of thermal buffer tube 50. Other means for maintaining the pressure and flow waves in phase which may be used in the practice of this invention include inertance tube and orifice, expander, linear alternator, bellows arrangements, and a work recovery line connected back to the compressor with a mass flux suppressor. In the expansion sequence, the working gas expands to produce working gas at the cold end of the thermal buffer tube 50. The expanded gas reverses its direction such that it flows from the thermal buffer tube toward regenerator 30. The relatively higher pressure gas in the reservoir flows through valve 70 to the warm end of the thermal buffer tube 50. In summary, thermal buffer tube 50 rejects the remainder of pressure-volume work generated by the compression as heat into warm heat exchanger 60.

The expanded working gas emerging from heat exchanger 40 is passed to regenerator 30 wherein it directly contacts the heat transfer media within the regenerator to produce the aforesaid cold heat transfer media, thereby completing the second part of the pulse tube refrigeration sequence and putting the regenerator into condition for the first part of a subsequent pulse tube refrigeration sequence.

Regenerator 30 contains heat transfer media 33. Examples of suitable heat transfer media in the practice of this invention include steel balls, wire mesh, high density honeycomb structures, expanded metals, lead balls, copper and its alloys, complexes of rare earth element(s) and transition metals. The pulsing or oscillating working gas is cooled in regenerator 30 by direct heat exchange with cold heat transfer media to produce cold pulse tube working gas.

The cryocooler of this invention has at least one flow straightener as defined below. The cryocooler illustrated in FIG. 1 is a preferred embodiment which has a plurality of flow straighteners identified by numerals 36, 37, 56 and 57. Flow straighteners 36 and 37 also serve as retainers to retain heat transfer media 33 within regenerator 30. The flow straighteners are positioned or oriented perpendicular to the longitudinal axis of the regenerator or thermal buffer tube so as to enhance gas flow uniformity through the regenerator or thermal buffer tube such as is described below.

Figure 2:
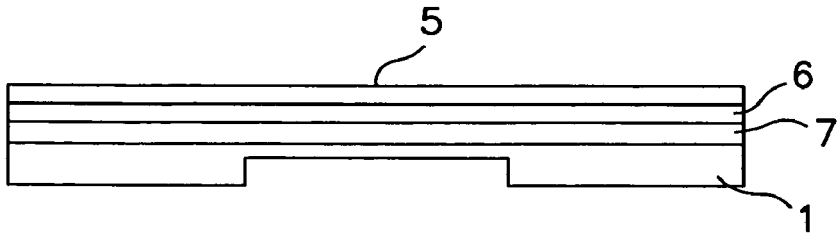
FIG. 2 is a cross sectional view of a preferred embodiment of a flow straightener for use in the practice of this invention.
Figure 3:
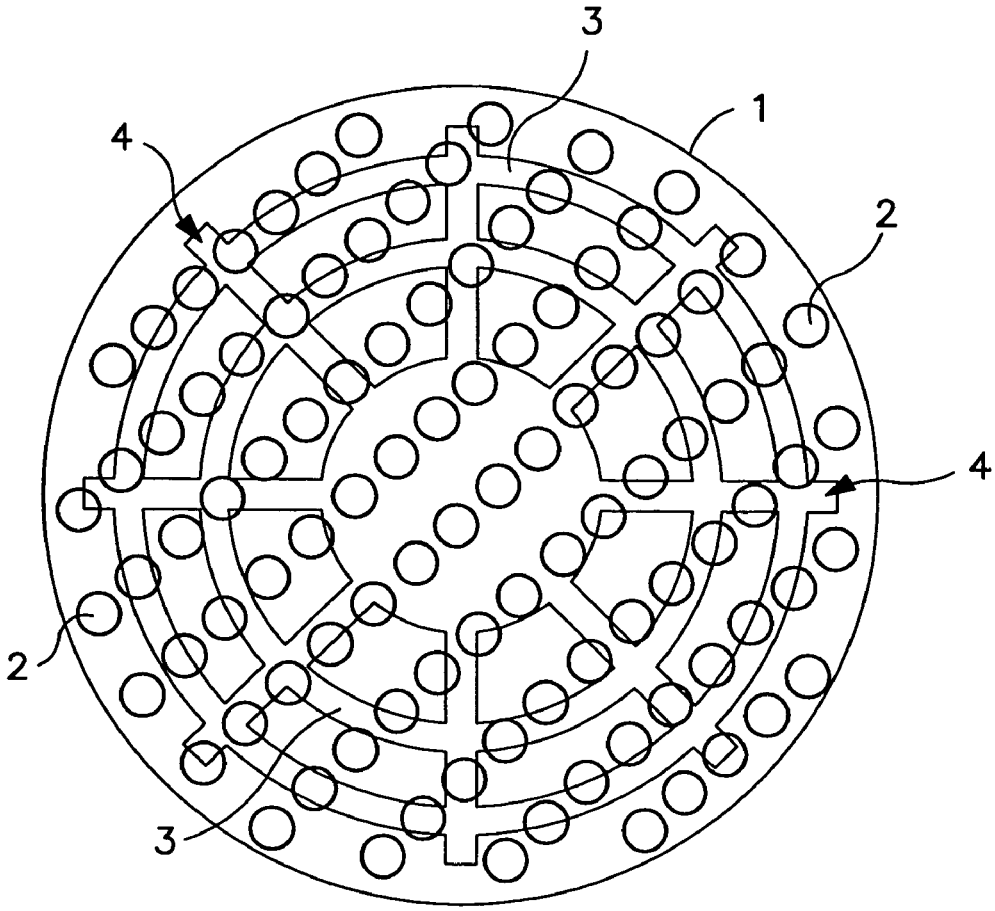
FIG. 3 is a plan view of a preferred embodiment of a flow straightener for use in the practice of this invention.

There is illustrated in FIGS. 2 and 3 in cross sectional and plan view respectively one preferred embodiment of a flow straightener for the practice of this invention. The numerals in FIGS. 2 and 3 are the same for the common elements.

Referring now to FIGS. 2 and 3 there is shown perforated plate 1 having a plurality of perforations 2. Plate 1 is typically constructed of stainless steel, copper, copper alloys, or aluminum. Preferably, as shown in FIG. 3, the perforations 2 are circular in shape although other shapes such as squares or rectangles may also be used. When circular perforations are employed the diameter of the circles is typically within the range of from 0.015 to 0.125 inch.

The plate 1 has a plurality of grooves on its surface. The embodiment illustrated in FIG. 3 is a preferred embodiment which has both circular shaped grooves 3 and radially oriented grooves 4 on the surface of plate 1. As the pulsing gas encounters the flow straightener, some of the pulsing gas passes through the perforations but some of the pulsing gas is stopped by the plate. Some of this stopped pulsing gas will then flow preferentially within the grooves along the plate surface and is thus better redistributed prior to passing through the perforations. This enhances the gas flow uniformity by providing faster and more even gas flow distribution across the surface of the flow straightener and consequently through the regenerator or thermal buffer tube. This counteracts the tendency of the heat transfer media to agglomerate, which improves heat transfer performance, and also improves the efficiency of the refrigeration generation of the pulsing gas.

Preferably, as illustrated in FIG. 2, the flow straightener includes one or more screens, such as fine mesh screen 5, coarse protective screen 6 and coarser support screen 7, which serve to improve the heat transfer media retaining function. Such screened flow straighteners would be advantageously employed as regenerator flow straighteners such as flow straighteners 36 and 37 of the embodiment illustrated in FIG. 1.

Figure 4:
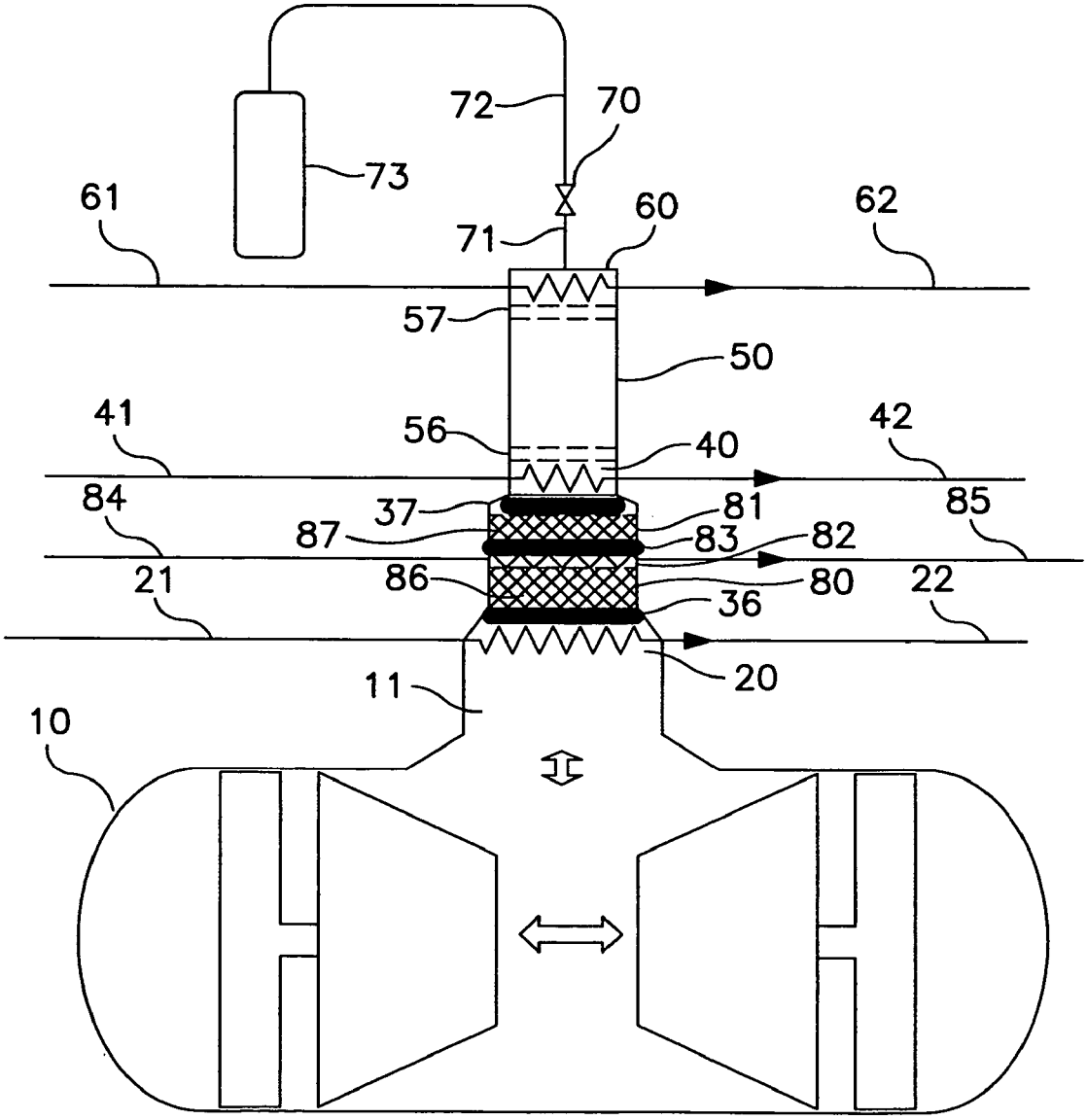
FIG. 4 is a representation of another preferred cryocooler assembly of this invention wherein the cryocooler is a two-stage pulse tube type cryocooler.

The pulse tube cryocooler illustrated in FIG. 1 exemplifies a single stage pulse tube cryocooler with a single regenerator and a single cold heat exchanger. In another embodiment of the invention, as illustrated in FIG. 4, the invention may be practiced with a two-stage pulse tube cryocooler. The numerals in FIG. 4 are the same as those of FIG. 1 for the common elements, and these common elements will not be described again in detail. In FIG. 4 there is shown a two-stage pulse tube cryocooler comprising two regenerators 80 and 81, a hot heat exchanger 20, a first stage heat exchanger 82, a cold heat exchanger 40 and flow straighteners 36, 83 and 37. Cryogenic fluid such as liquid nitrogen 84, 85 cools the working gas by indirect heat exchange in first stage heat exchanger 82 to enable delivery of refrigeration at 30K or lower by the cold heat exchanger 40. The heat transfer media 86 and 87 of the two regenerators may be the same or different.

Although the invention has been described in detail with reference to certain preferred embodiments, those skilled in the art will recognize that there are other embodiments of the invention within the spirit and the scope of the claims.

The invention claimed is:

1. A pulse tube type cryocooler comprising a pressure wave generator and a regenerator which contains heat transfer media, and having at least one flow straightener to enhance gas flow uniformity through the regenerator, the at least one flow straightener positioned at least at one end of the regenerator and perpendicular to a longitudinal axis running through the regenerator, in direction of the gas flow of the heat transfer media so as to retain the heat transfer media within the regenerator, the at least one flow straightener comprising a plate having a plurality of perforations, radially oriented grooves and at least one circular shaped groove intersecting the radially oriented grooves in the plate surface to enable the gas flow striking the plate to preferentially be distributed along the grooves to the perforations.

2. The cryocooler of claim 1 wherein the flow straightener additionally comprises at least one screen.

3. The cryocooler of claim 2 wherein the flow straightener comprises a plurality of screens of differing mesh sizes.

4. A pulse tube type cryocooler comprising a pressure wave generator and a thermal buffer tube, and at least one flow straightener to enhance gas flow uniformity through the thermal buffer tube, the at least one flow straightener positioned at least at one end of the thermal buffer tube and perpendicular to a longitudinal axis running through the thermal buffer tube in a direction of the gas flow and comprising a plate having a plurality of perforations and a plurality of radially oriented grooves at least one circular shaped groove intersecting the radially oriented grooves in the plate surface to enable the gas flow striking the plate to preferentially be distributed along the grooves to the perforations.

5. A method for operating a pulse tube type cryocooler comprising generating a pulsing gas flow within the cryocooler which contains at least one flow straightener comprising a plate oriented at right angles to the pulsing gas flow and having a plurality of perforations and a plurality of radially oriented grooves and at least one circular shaped groove intersecting the radially oriented grooves in the plate surface, and passing some of said gas along the plate surface within the grooves prior to passing the gas through said perforations.

* * * * *